US005989069A

United States Patent [19]

Tan

[11] Patent Number: 5,989,069

[45] Date of Patent: Nov. 23, 1999

[54] ELECTRIC JACK

[75] Inventor: Ying Wu Tan, Tao-Yuan Hsien, Taiwan

[73] Assignee: Speed Tech Corp., Tao Yuan Hsien, Taiwan

[21] Appl. No.: 09/170,873

[22] Filed: Oct. 13, 1998

[30] Foreign Application Priority Data

Oct. 16, 1997 [TW] Taiwan ..... 86217505

[51] Int. Cl.[6] ..... H01Q 13/66

[52] U.S. Cl. ..... 439/620; 439/676

[58] Field of Search ..... 439/620, 607, 439/609, 676

[56] References Cited

U.S. PATENT DOCUMENTS

| | | | |
|---|---|---|---|
| 5,456,619 | 10/1995 | Briones | 439/620 |
| 5,647,767 | 7/1997 | Scheer et al. | 439/620 |
| 5,688,145 | 11/1997 | Liu | 439/607 |
| 5,736,910 | 4/1998 | Townsend et al. | 439/620 |

*Primary Examiner*—Michael L. Gellner
*Assistant Examiner*—Antoine Ngandjui
*Attorney, Agent, or Firm*—Pro-Techtor International Services

[57] ABSTRACT

An electric jack for communication between a mainboard in a telephone network or local area network and a module plug of an external signal line, including a plastic shell, a metal shell covered on the plastic shell to eliminate external electromagnetic interference, a terminal block mounted inside the plastic shell, the terminal block holding a first row of terminals adapted to contact respective terminals on the module plug of the external signal line, and a second row of terminals connected to respective electric contacts on the mainboard, and a filter module mounted in a rear open side of the metal shell and fastened to a back side of the terminal block to eliminate noises from signal passing from the module plug of the external signal line to the mainboard, the filter module having a filter circuit board connected between the first row of terminals and second row of terminals on the terminal block and adapted to eliminate noises from signal passing from the module plug of the external signal line to the mainboard, and an iron core covered on the filter circuit board.

7 Claims, 3 Drawing Sheets

ELECTRIC JACK

BACKGROUND OF THE INVENTION

The present invention relates to an electric jack adapted for mounting on a mainboard in a telephone network or local area network for receiving a module plug from an external signal line, and more particularly to such an electric jack which comprises a filter module fastened to a terminal block thereof to eliminate noises from incoming signal passing to the mainboard.

A regular electric jack for mounting on a mainboard in a telephone network or local area network for receiving a module plug from an external signal line, is generally comprised of a plastic shell, a terminal block mounted inside the plastic shell and holding a plurality of terminals, and a metal shell covered on the plastic shell to eliminate external electromagnetic interference. When an electric jack of this structure is mounted on a mainboard in a telephone network or local area network, the terminals of the electric jack are connected to respective electric contacts on the mainboard. Further, in order to eliminate noises from incoming signal passing to the mainboard, a filter circuit is needed. A filter circuit for this purpose is directly installed in the mainboard circuit. However, the installation of this filter circuit occupies much mainboard space, and complicates the arrangement of the circuit on the mainboard.

SUMMARY OF THE INVENTION

The present invention has been accomplished to provide an electric jack which eliminates the aforesaid problem. According to one aspect of the present invention, the electric jack comprises a plastic shell, a metal shell covered on the plastic shell to eliminate external electromagnetic interference, a terminal block mounted inside the plastic shell, the terminal block holding a first row of terminals adapted to contact respective terminals on the module plug of the external signal line connected thereto, and a second row of terminals connected to respective electric contacts on the mainboard on which the electric jack is mounted, and a filter module mounted in a rear open side of the metal shell and fastened to a back side of the terminal block to eliminate noises from signal passing from the module plug of the external signal line to the mainboard, the filter module having a filter circuit board connected between the first row of terminals and second row of terminals on the terminal block and adapted to eliminate noises from signal passing from the module plug of the external signal line to the mainboard, and an iron core covered on the filter circuit board. According to another aspect of the present invention, the circuit board has a plurality of mounting holes, the terminal block has a plurality of mounting rods respectively fitted into the mounting holes on the circuit board to secure the circuit board in place. According to another aspect of the present invention, the circuit board has two coupling notches at two opposite side edges thereof, the iron core has two coupling portions bilaterally raised from its front side and respectively forced into engagement with the coupling notches on the circuit board.

DETAILED DESCRIPTION OF THE PREFERRED EMBODIMENT

Figure 1:
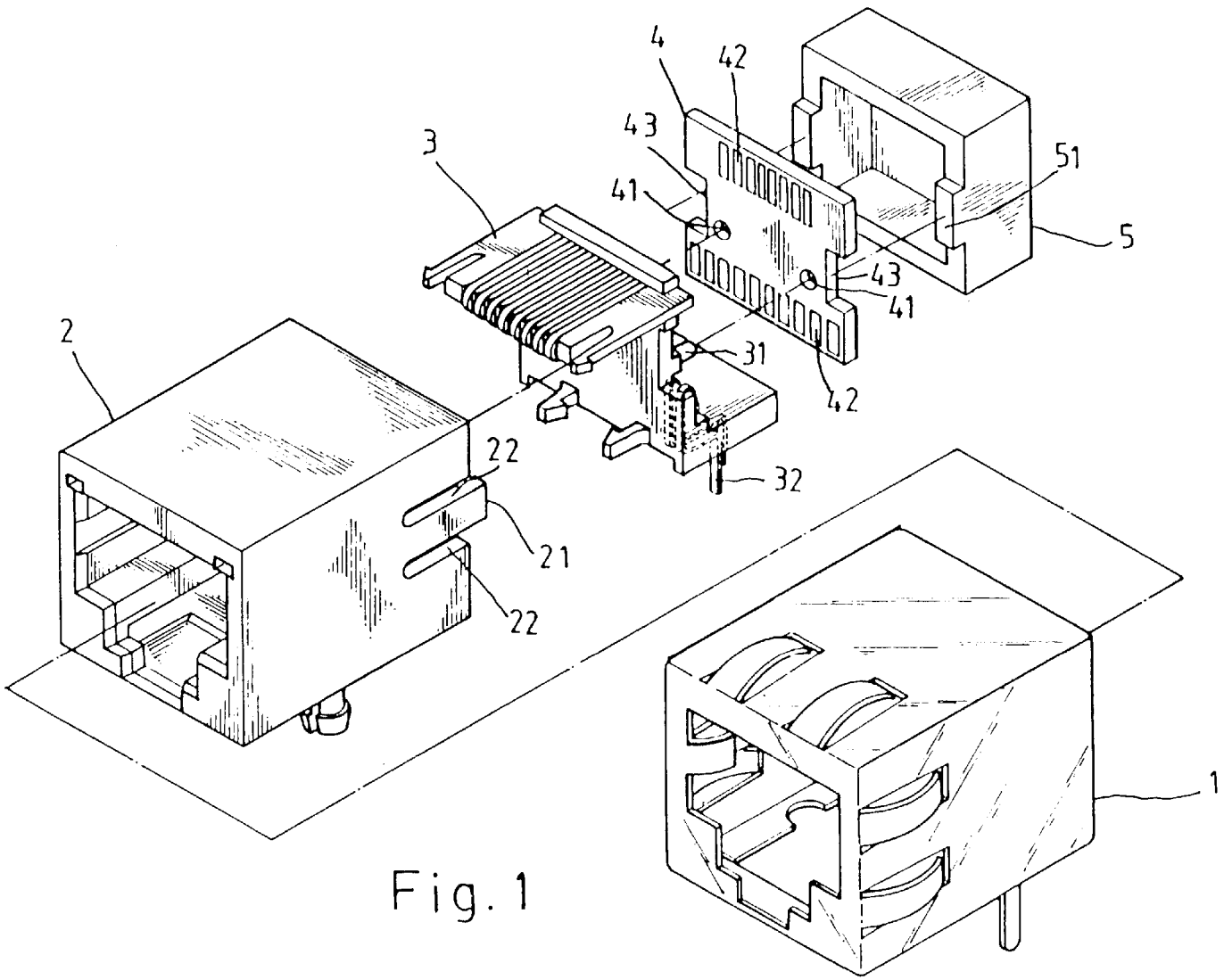
FIG. 1 is an exploded view of an electric jack according to the present invention.
Figure 4:
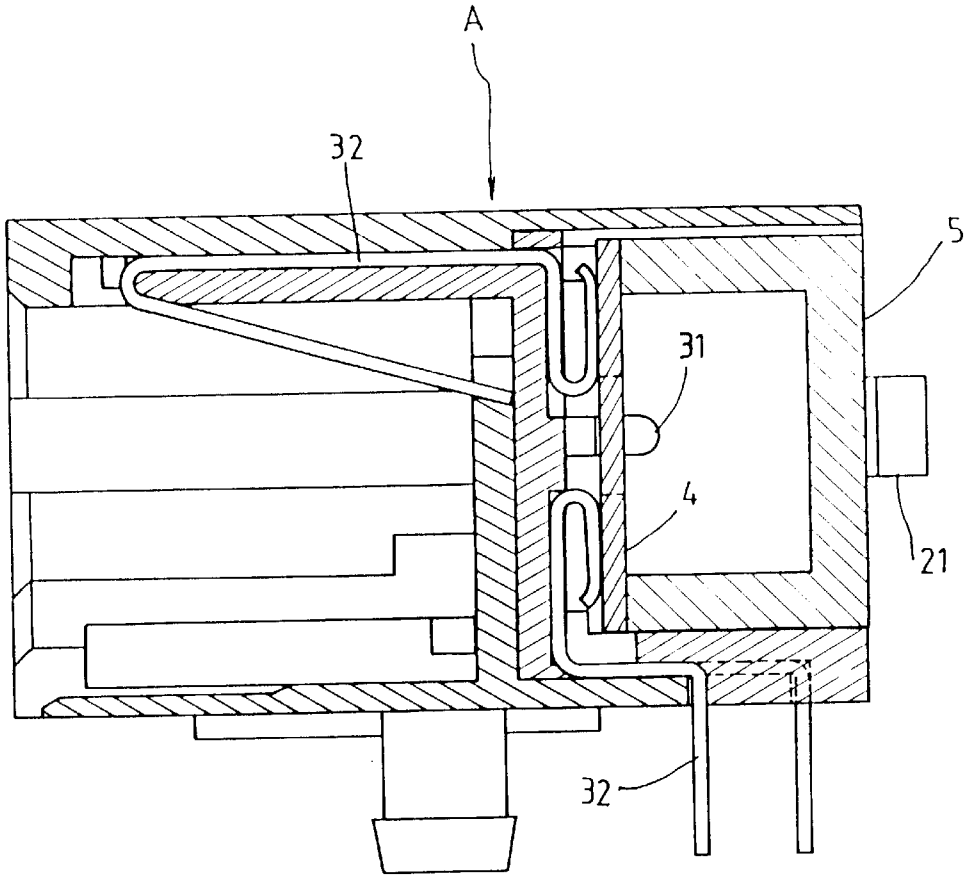
FIG. 4 is a sectional view in an enlarged scale of the assembly of the electric jack shown in FIG. 1.
Figure 2:
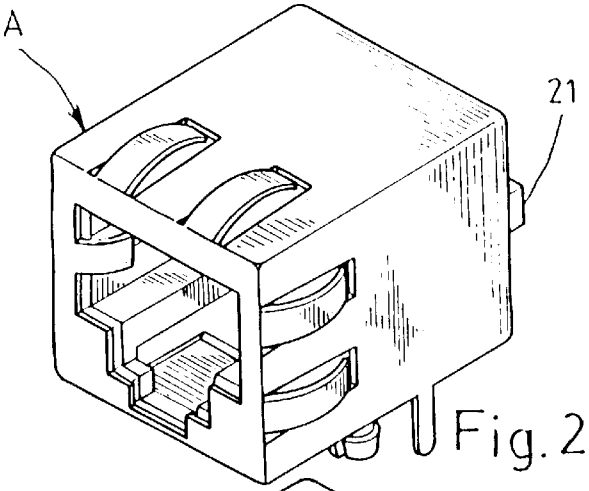
FIG. 2 is an oblique front view of the assembly of the electric jack shown in FIG. 1.
Figure 3:
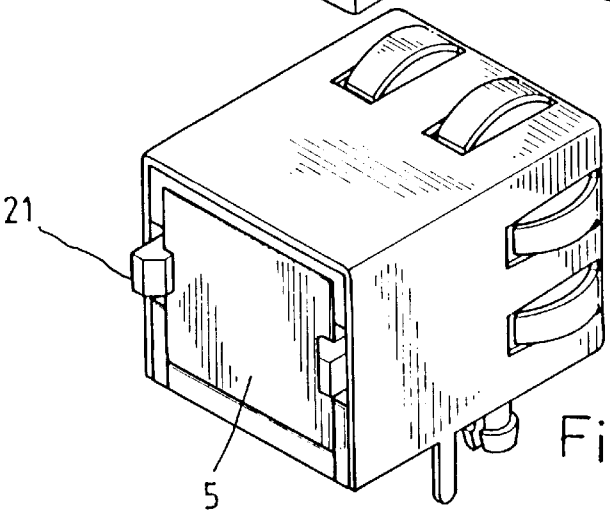
FIG. 3 is an oblique rear view of the assembly of the electric jack shown in FIG. 1.
Figure 5:
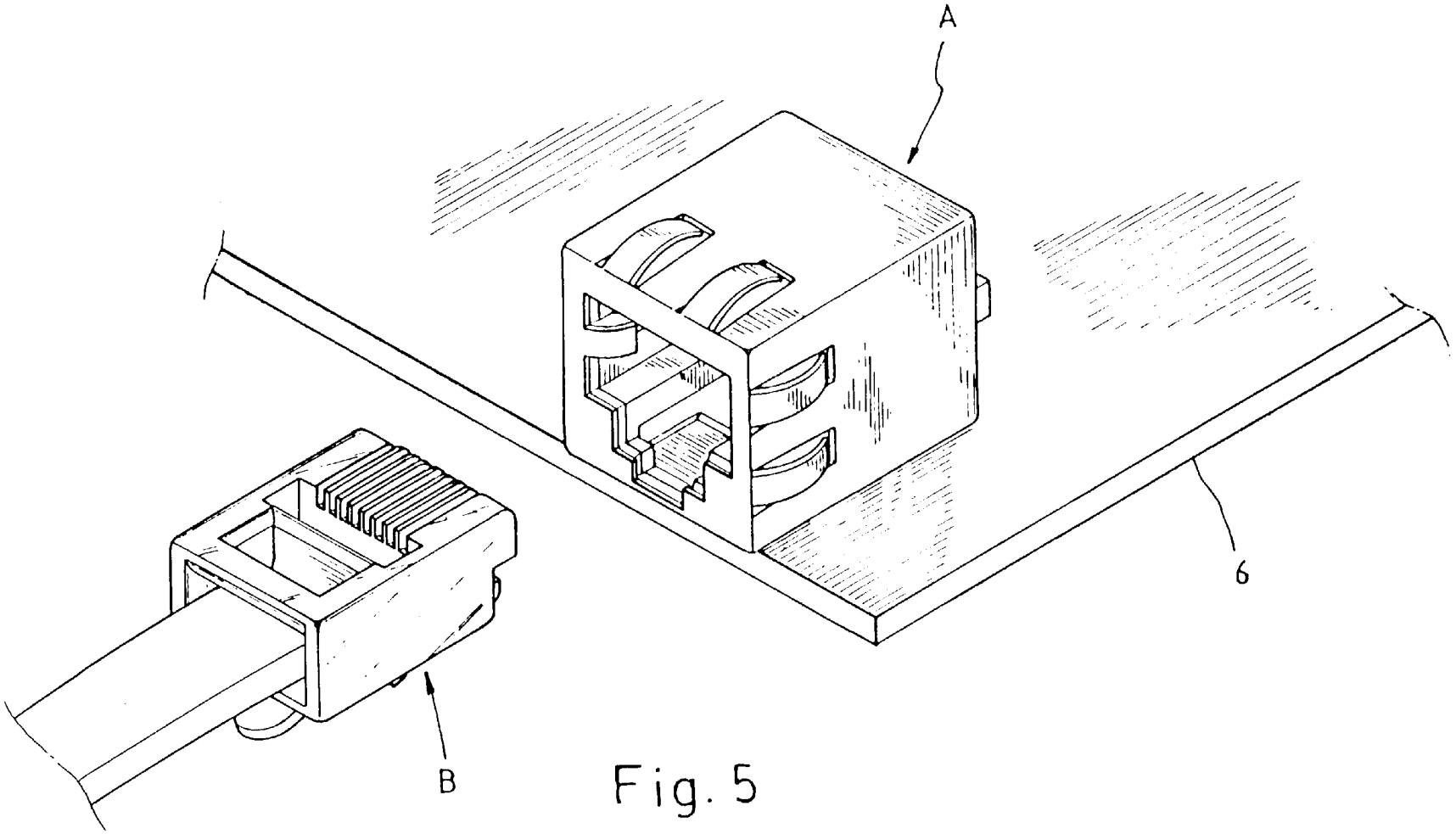
FIG. 5 is an applied view of the present invention, showing the electric jack installed in a mainboard, and the relationship between the electric jack and an external module plug.

Referring to FIGS. 1 and 5, an electric jack A is mounted on a mainboard 6 and adapted to receive a module plug B from an external signal line, comprised of a metal shell 1, a plastic shell 2, a terminal block 3, and a filter module formed of a circuit board 4 and an iron core 5.

Referring to Figures from 2 to 4 and FIGS. 1 and 5 again, the metal shell 1 is covered on the plastic shell 2 to eliminate electromagnetic interference. The terminal block 3 is mounted inside the plastic shell 2, and holds a plurality of terminals for contact with terminals of the module plug B respectively. The plastic shell 2 comprises two hooks 21 bilaterally disposed at its back side. The hooks 21 are integral with two opposite lateral side walls of the plastic shell 2. Two elongated slots 22 are longitudinally provided at each lateral side wall of the plastic shell 2 at two opposite sides of each hook 21. Because of the design of the elongated slots 22 on each lateral side wall of the plastic shell 2. the hooks 21 are able to return to their former shape after being bent outwards. The terminal block 3 comprises two rows of terminals 32, and a plurality of mounting rods 31. The circuit board 4 is mounted inside the plastic shell 2 and connected to the terminal block 3, having a plurality of mounting holes 4 forced into engagement with the mounting rods 31 on the terminal block 3, a plurality of electric contacts 42 respectively disposed in contact with the terminals 32 on the terminal block 3 for permitting the terminals 32 of the terminal block 3 to be electrically connected to the mainboard 6, and two coupling notches 43 at two opposite side edges thereof. The iron core 5 is closed on the rear open side of the metal shell 2 and fastened to the circuit board 4 at its back side opposite to the terminal block 3, and secured in place by the hooks 21 of the metal shell 2. The iron cover 5 has two coupling portions 51 bilaterally raised from its front side and respectively fitted into the coupling notches 43 on the circuit board 4. Further, the circuit board 4 comprises a filter circuit connected between the two rows of terminals 32 on the terminal block 3, and adapted to remove noises from signal coming from the external module plug B to the mainboard 6 (signal from the external module plug B is transmitted through a first row of terminals on the terminal block 3, then processed through the filter circuit of the circuit board 4, and then transmitted to the mainboard 6 through the second row of terminals on the terminal block 3; i.e., the first row of terminals on the terminal block 3 are adapted to receive respective terminals on the external module plug B, and the second row of terminals on the terminal blocks 3 are connected to respective contacts on the mainboard 6).

Because the electric jack A is detachable, the maintenance work of the electric jack A can be easily performed. Furthermore, the iron core 5 of the electric jack A eliminates magnetic waves from electric signal before electric signal is transmitted to the mainboard 6.

It is to be understood that the drawings are designed for purposes of illustration only, and are not intended as a definition of the limits and scope of the invention disclosed.

What the invention claimed is:

1. An electric jack for communication between a mainboard and a module plug of an external signal line, comprising a plastic shell, a metal shell covered on said plastic shell to eliminate external electromagnetic interference, and a terminal block mounted inside said plastic shell, said terminal block holding a first row of terminals adapted to contact respective terminals on said module plug of said external signal line, and a second row of terminals connected to respective electric contacts on said mainboard, wherein a filter module is mounted in a rear open side of said metal shell and fastened to a back side of said terminal block to eliminate noises from signal passing from said module plug of said external signal line to said mainboard, said filter module connected between said first row of terminals and second row of terminals on said terminal block and adapted to eliminate noises from signal passing from said module plug of said external signal line to said mainboard.

2. The electric jack of claim 1, wherein said filter module comprises a circuit board fastened to said terminal block at a back side, and an iron core mounted within said metal shell and covered on said circuit board at a back side opposite to said terminal block, said circuit board comprising a filter circuit connected between said first row of terminals and second row of terminals on said terminal block and adapted to eliminate noises from signal passing through, and a plurality of mounting holes; said terminal block comprises a plurality of mounting rods raised from a back side thereof and respectively fitted into the mounting holes on said circuit board.

3. The electric jack of claim 2, wherein said filter circuit of said circuit board comprises a plurality of electric contacts respectively disposed in contact with said first row of terminals and second row of terminals on said terminal block.

4. The electric jack of claim 2, wherein said metal shell comprises two hooks integral with two opposite lateral side walls thereof and respectively hooked on said iron core to hold it in place.

5. The electric jack of claim 2, wherein said circuit board comprises two coupling notches at two opposite side edges thereof for the mounting of said iron core.

6. A The electric jack of claim 5, wherein said iron core comprises two coupling portions bilaterally raised from a front side thereof and respectively forced into engagement with the coupling notches on said circuit board.

7. The electric jack of claim 6, wherein said metal shell comprises two pairs of longitudinal slots at its two opposite lateral side walls at two opposite sides of each of said hooks.

* * * * *